US010801518B2

(12) United States Patent
Nakashima et al.

(10) Patent No.: US 10,801,518 B2
(45) Date of Patent: Oct. 13, 2020

(54) BLOWER APPARATUS

(71) Applicant: Mitsubishi Electric Corporation, Tokyo (JP)

(72) Inventors: Seiji Nakashima, Tokyo (JP); Takahide Tadokoro, Tokyo (JP); Shuhei Mizutani, Tokyo (JP); Yutaka Aoyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 94 days.

(21) Appl. No.: 16/069,957

(22) PCT Filed: Feb. 26, 2016

(86) PCT No.: PCT/JP2016/055867
§ 371 (c)(1),
(2) Date: Jul. 13, 2018

(87) PCT Pub. No.: WO2017/145370
PCT Pub. Date: Aug. 31, 2017

(65) Prior Publication Data

US 2019/0010960 A1 Jan. 10, 2019

(51) Int. Cl.
*F04D 29/66* (2006.01)
*F24F 1/38* (2011.01)
(Continued)

(52) U.S. Cl.
CPC ..... *F04D 29/665* (2013.01); *F04D 25/0613* (2013.01); *F04D 29/547* (2013.01); *F24F 1/38* (2013.01); *F05B 2260/96* (2013.01)

(58) Field of Classification Search
CPC ..... F24F 1/38
See application file for complete search history.

(56) References Cited

U.S. PATENT DOCUMENTS 9,822,801 B2 * 11/2017 Nakagawa ..... F24F 1/50
10,393,150 B2 * 8/2019 Nakagawa ..... F04D 29/544
(Continued)

FOREIGN PATENT DOCUMENTS

JP 10-068537 A 10/1998
JP 2009-204291 9/2009
JP 2015-129504 A 7/2015

OTHER PUBLICATIONS

International Search Report of the International Searching Authority dated May 31, 2016 for the corresponding international application No. PCT/JP2016/055867 (and English translation).

*Primary Examiner* — Kenneth J Hansen
*Assistant Examiner* — Jason Fountain
(74) *Attorney, Agent, or Firm* — Posz Law Group, PLC

(57) ABSTRACT

A blower apparatus includes a propeller fan configured to rotate about a rotational axis, and a bell mouth annularly disposed to surround the propeller fan as seen in a direction of the rotational axis of the propeller fan. The bell mouth includes a flare portion located downstream of the propeller fan The flare portion has at least one first part and at least one second part. The first part has a first inner circumferential surface region. The second part as a second inner circumferential surface region. A first length of the first part inner circumferential surface region in the direction of the rotational axis is greater than a second length of the second part inner circumferential surface region in the direction of the rotational axis.

6 Claims, 9 Drawing Sheets

(51) Int. Cl.
*F04D 25/06* (2006.01)
*F04D 29/54* (2006.01)

(56) References Cited

U.S. PATENT DOCUMENTS

| | | | | |
|---|---|---|---|---|
| 10,495,328 | B2 * | 12/2019 | Yamamoto | F24F 1/40 |
| 2006/0045777 | A1 * | 3/2006 | Kao | F04D 29/541 417/423.14 |
| 2016/0281739 | A1 * | 9/2016 | Nakagawa | F04D 19/002 |
| 2018/0224135 | A1 * | 8/2018 | Yamamoto | F24F 1/40 |

* cited by examiner

BLOWER APPARATUS

CROSS REFERENCE TO RELATED APPLICATION

This application is a U.S. national stage application of PCT/JP2016/055867 filed on Feb. 26, 2016, the contents of which are incorporated herein by reference.

TECHNICAL FIELD

The present invention relates to a blower apparatus for use in, for example, an air conditioner or a ventilator.

BACKGROUND ART

Japanese Patent Laying-Open No. 2015-129504 (PTD 1) discloses a blower apparatus including a propeller fan, a bell mouth part, and a diffuser part as an example of a conventional blower apparatus. The bell mouth part is spaced from an outer circumferential end of the propeller fan by a predetermined distance in the radial direction. The diffuser part is provided downstream of the bell mouth part. At least a part of the inner circumferential surface of the diffuser part is provided as an inclined surface which is inclined outwardly in the radial direction as closer to the downstream side. The diffuser part is configured such that a diffuser angle varies in a circumferential direction, where the diffuser angle is an angle formed between the inclined surface and a rotational axis line of the fan.

In the blower apparatus described in PTD 1, the downstream end of the diffuser part is always provided on the same plane of the propeller fan in the circumferential direction irrespective of the magnitude of the diffuser angle.

CITATION LIST

Patent Document

PTD 1: Japanese Patent Laying-Open No. 2015-129504

SUMMARY OF INVENTION

Technical Problem

The blower apparatus described in PTD 1 which has the above configuration does not sufficiently reflect the effect of a friction loss on the inclined surface (in particular, a region with a small diffuser angle) of the diffuser part. The present inventors have successfully reduced the input and noise of the blower apparatus by reflecting a friction loss on the inclined surface of the diffuser part.

A main object of the present invention is to provide a blower apparatus capable of reducing input and noise.

Solution to Problem

A blower apparatus according to the present invention includes a propeller fan configured to rotate about a rotational axis, and a bell mouth annularly disposed to surround the propeller fan as seen in a direction of the rotational axis of the propeller fan. The bell mouth includes a flare portion located downstream of the propeller fan in the direction of the rotational axis. The flare portion has an inner circumferential surface located inside in the direction of the propeller fan. The inner circumferential surface is inclined with respect to the rotational axis, with a distance between the inner circumferential surface and the rotational axis increasing downstream in the direction of the rotational axis. The flare portion has at least one first part and at least one second part located at different positions in a rotational direction of the propeller fan. The first part has a first inner circumferential surface region that is a part of the inner circumferential surface. The second part has a second inner circumferential surface region that is a part of the inner circumferential surface. A first angle formed between the first inner circumferential surface region of the first part and the rotational axis in a cross section passing through the rotational axis and a part of the first part is greater than a second angle formed between the second inner circumferential surface region of the second part and the rotational axis in a cross section passing through the rotational axis and a pan of the second part. A first length of the first inner circumferential surface region in the direction of the rotational axis is greater than a second length of the second inner circumferential surface region in the direction of the rotational axis.

Advantageous Effects of Invention

The present invention can provide a blower apparatus capable of reducing input and noise.

DESCRIPTION OF EMBODIMENTS

Figure 1:
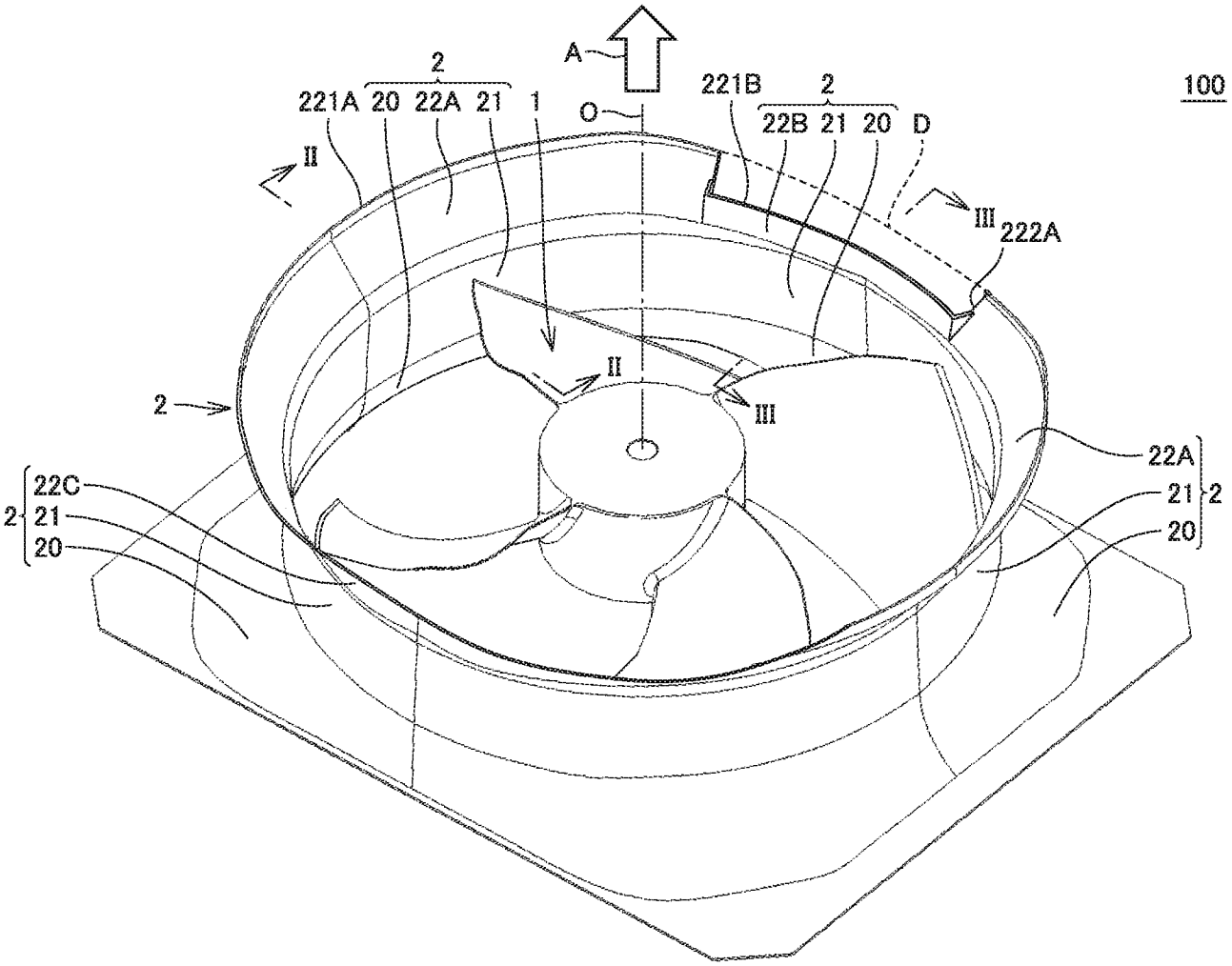
FIG. 1 is a perspective view of a blower apparatus according to Embodiment 1.

Embodiments of the present invention will be described below with reference to the drawings, in which the same or corresponding parts will be designated by the same reference numerals, and a description thereof will not be repeated.

Embodiment 1

Figure 2:
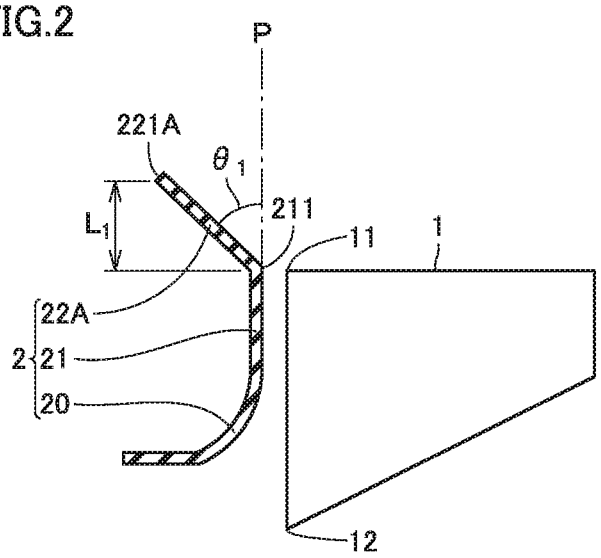
FIG. 2 is a sectional view seen from a line segment II-II in FIG. 1.
Figure 3:
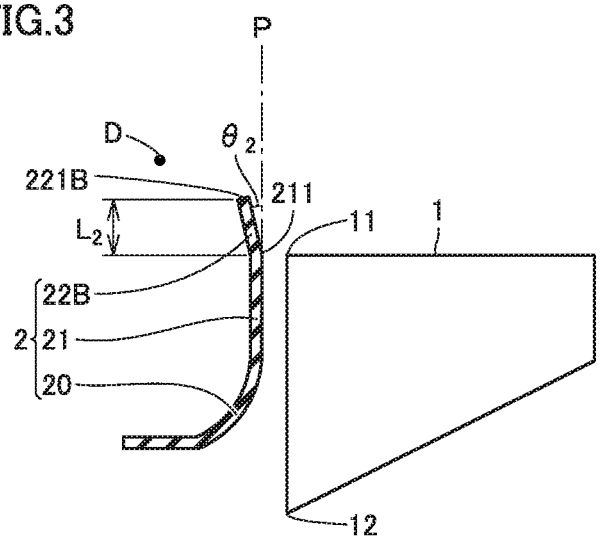
FIG. 3 is a sectional view seen from a line segment III-III in FIG. 1.

A blower apparatus 100 according to Embodiment 1 will be described with reference to FIGS. 1 to 3. Blower apparatus 100 includes a propeller fan 1, a bell mouth 2, and a motor (not shown). Propeller fan 1 is provided rotatably about a rotational axis O. Propeller fan 1 is rotatably driven by the motor. As shown in FIG. 1, blower apparatus 100 produces an airflow in a direction of an arrow A by propeller fan 1 rotatably driven. As shown in FIG. 2, propeller fan 1 has an end 11 (first end) located downstream and an end 12 (third end) located upstream Axes P shown in FIGS. 2 and 3 is parallel to rotational axis O shown in FIG. 1.

Bell mouth 2 is annularly disposed to surround propeller fan 1 when blower apparatus 100 is seen in the direction of the rotational axis of propeller fan 1 (hereinafter, merely referred to as the rotation of the rotational axis). Bell mouth 2 is disposed such that its central axis coincides with rotational axis O. Bell mouth 2 has a curved inlet portion 20, a pipe portion 21, and a flare portion 22 divided in the direction of the rotational axis. Curved inlet portion 20, pipe portion 2, and flare portion 22 are annularly disposed to surround rotational axis O.

Curved inlet portion 20 is located upstream of pipe portion 21. Flare portion 22 is located downstream of pipe portion 21. An end of bell mouth 2 which is located upstream is an end of curved inlet portion 20 which is located upstream. Ends of bell mouth 2 which are located downstream are ends 221A and 221B of flare portion 22 located downstream. In bell mouth 2, for example, an end of curved inlet portion 20 which is located downstream is connected to the end of pipe portion 21 which is located upstream, and the end of pipe portion 21 which is located downstream is connected to an end of flare portion 22 which is located upstream. Flare portion 22 is located downstream of propeller fan 1. The end of flare portion 22 located upstream is provided, for example, on the same plane as that of an end of propeller fan 1 which is located downstream. The plane is perpendicular to rotational axis O.

Curved inlet portion 20 has an inner circumferential surface inclined with respect to rotational axis O, with a distance between the inner circumferential surface and rotational axis O increasing from downstream to upstream. In the cross section passing through rotational axis O and a part of curved inlet portion 20, the inner circumferential surface of curved inlet portion 20 has a curvature centered around a point located outside relative to curved inlet portion 20. The outer circumferential surface of a part of curved inlet portion 20 which has the inner circumferential surface is, for example, inclined with respect to rotational axis O, with a distance between the outer circumferential surface and rotational axis O increasing from downstream to upstream. The outer circumferential surface of the part of curved inlet portion 20 which has the inner circumferential surface has also, for example, a curvature centered around a point located outside relative to curved inlet portion 20.

Pipe portion 21 has a uniform inside diameter irrespective of, for example, its location in the direction of the rotational axis. Curved inlet portion 20 and pipe portion 21 have, for example, annular sectional shapes orthogonal to rotational axis O. An end 211 of pipe portion 21 which is located downstream, that is, the end of flare portion 22 located upstream is always disposed on the same plane orthogonal to rotational axis O.

Flare portion 22 has an inner circumferential surface inclined with respect to rotational axis O to have a larger inside diameter from upstream to downstream. In other words, flare portion 22 has an inner circumferential surface inclined with respect to rotational axis O, with a distance between the inner circumferential surface and rotational axis O increasing from upstream to downstream. The inner circumferential surface of flare portion 22 has a first inner circumferential surface region disposed in a first part 22A, which will be described below, and a second inner circumferential surface region disposed in a second part 22B, which will be described below. In the cross section passing through rotational axis O and a part of the first inner circumferential surface region of flare portion 22, the first inner circumferential surface region is disposed to form a straight line. In the cross section passing through rotational axis O and a part of the second inner circumferential surface region of flare portion 22, the second inner circumferential surface region is provided to form a straight line. A flare angle formed between the inner circumferential surface of flare portion 22 and rotational axis O differs depending on the position of flare portion 22 in the circumferential direction. A flare angle (first angle $\theta_1$) formed between the first inner circumferential surface region of first part 22A and rotational, axis O differs from a flare angle (second angle $\theta_2$) formed between the second inner circumferential surface region of second part 22B and rotational axis O. That is to say, the first inner circumferential surface region and the second inner circumferential surface region are each provided as a part of a conical surface having a different apex angle.

Flare portion 22 has a protrusion and a recess in which the end of bell mouth 2 located downstream is provided in the direction of the rotational axis in a protruding manner and in a recessed manner, respectively, when bell mouth 2 is seen laterally in the direction perpendicular to rotational axis O. The shortest distance (the length in the rotational axis direction) between the end of flare portion 22 located upstream, that is, the end of pipe portion 21 located downstream and the end of flare portion 22 located downstream differs depending on the position of flare portion 22 in the circumferential direction.

Flare portion 22 has first part 22A and second part 22B disposed at different positions in the rotational direction of propeller fan 1, that is, in the circumferential direction of flare portion 22. First part 22A is disposed to sandwich second part 22B therein in the circumferential direction of flare portion 22. First part 22A and second part 22B are adjacent to each other in the circumferential direction of flare portion 22. It suffices that second part 22B is disposed in a region that needs to have a reduced flare angle in consideration of, for example, the space in which blower apparatus 100 is installed or the distribution of an inlet flow rate of blower apparatus 100. First part 22A has ends located upstream, that is, end 211 of pipe portion 21 located downstream and end 221A located downstream. Second part 22B has an end located upstream, that is, end 211 of pipe portion 21 located downstream and end 221B (second end) located downstream. The ends of first part 22A and second part 22B located upstream are connected to the end of pipe portion 21 located downstream and disposed, on the same plane orthogonal to rotational axis O. The ends of first part 22A and second part 22B located downstream are not disposed on the same plane orthogonal to rotational axis O.

A ratio of the length between end 221B and end 11 in the direction of the rotational axis of propeller fan 1 to the length between end 11 and end 12 in the direction of the rotational axis of propeller fan 1 may have any magnitude, which is, for example, 1% or more.

A dotted line D shown in FIG. 1 is an imaginary line showing for reference a region in which end 221A located downstream is disposed in a conventional configuration in which no second part 22B is provided, that is, the configuration in which first part 22A is provided in place or second part 22B. As shown in FIGS. 1 and 3, end 221B of second part 22B is located upstream of dotted line D and is also located at the side closer to the interior of flare portion 22 with respect to dotted line D in the radial direction of propeller fan 1. Ends 221A and 221B of flare portion 22 located downstream are located downstream of the end of propeller fan 1 located downstream.

In a cross section passing through rotational axis O and a part of first part 22A a flare angle formed between the first inner circumferential surface region of first part 22A and rotational axis O (axis P) is a first angle $\theta_1$ (see FIG. 2). In a cross section passing through rotational axis O and a part of second part 22B, a flare angle formed between the second inner circumferential surface region of second part 22B and rotational axis O (axis P) is a second angle $\theta_2$ (see FIG. 3). First angle $\theta_1$ is greater than second angle $\theta_2$. First angle $\theta_1$ is, for example, 5° or more and 85° or less. Second angle $\theta_2$ is, for example, 0° or more and 80° or less.

A distance between the end of first part 22A (first inner circumferential surface region) located upstream and end 221A located downstream in the direction of the rotational axis is a first length $L_1$ (see FIG. 2). A distance between the end of second part 22B (second inner circumferential surface region) located upstream and end 221B located downstream in the direction of the rotational axis is a second length $L_2$ (see FIG. 3). First length $L_1$ of first part 22A is greater than second length $L_2$ of second part 22B. The ratio of second length $L_2$ to first length $L_1$ is, for example, greater than 1 and smaller than 100.

First angle $\theta_1$ is greater and second angle $\theta_2$ is smaller than any other flare angle formed between the inner circumferential surface of flare portion 22 and rotational axis O (axis P). First length $L_1$ is greater and second length $L_2$ is smaller than any other distance between the end of flare portion 22 located upstream and the end of flare portion 22 located downstream in the direction of the rotational axis.

First part 22A is a protrusion provided in a protruding manner in the direction of the rotational axis when bell mouth 2 is seen laterally in the direction perpendicular to rotational axis O. Second part 22B is a recess provided in a recessed manner in the direction of the rotational axis when bell mouth 2 is seen laterally in the direction perpendicular to rotational axis O.

Opposite ends of second part 22B in the circumferential direction of flare portion 22 are each connected to first part 22A. An angle formed between the opposite ends of second part 22B in the circumferential direction of flare portion 22 with respect to the central axis (rotational axis O) of flare portion 22 is, for example, 90° or less. As described above, first part 22A and second part 22B have different flare angles (first angle $\theta_1$>second angle $\theta_2$), and first length $L_1$ of first part 22A differs from second length $L_2$ of second part 22B (first length $L_1$>second length $L_2$). End 221B of second part 22B located downstream accordingly projects inside in the radial direction of flare portion 22 (in the radial direction of propeller fan 1) with respect to an intermediate part of first part 22A which is adjacent to end 221B in the circumferential direction of flare portion 22. That is to say, a step is formed at the part connecting first part 22A and second part 22B to each other.

First part 22A has a lateral end 222A in the circumferential direction of flare portion 22. Lateral end 222A of first part 22A in the circumferential direction of flare portion 22 connects end 221A of first part 22A located downstream and end 221B of second part 22B located downstream to each other.

As shown in FIG. 1, flare portion 22 may further include a flare part 22C having, for example, the configuration excluding first part 22A and second part 22B. Flare part 22C is provided at, for example, a position facing second part 22B with rotational axis O therebetween. Flare part 22C has, for example, a flare angle which is equal to or more than second angle $\theta_2$ and also has a shortest distance between the end thereof located upstream and an end thereof located downstream which is equal to or more than first length $L_1$. In this case, first parts 22A are provided at two locations facing each other with rotational axis O therebetween in the circumferential direction of flare portion 22.

The function and effect of blower apparatus 100 according to Embodiment 1 will now be described. Blower apparatus 100 includes propeller fan 1 configured to rotate about the rotational axis and bell mouth 2 annularly disposed to surround propeller fan 1 as seen in the direction of the rotational axis of propeller fan 1. Bell mouth 2 includes flare portion 22 located downstream of propeller fan 1 in the direction of the rotational axis. Flare portion 22 has an inner circumferential surface inclined with respect to rotational axis O, with a distance between the inner circumferential surface and rotational axis O increasing downstream in the direction of the rotational axis. Flare portion 22 has first part 22A and second part 22B located at different positions in the rotational direction of propeller fan 1. First part 22A has a first inner circumferential surface region that is a part of the inner circumferential surface of flare portion 22. Second part 22B has a second inner circumferential surface region that is a part of the inner circumferential surface of flare portion 22. First angle $\theta_1$ formed between the first inner circumferential surface region of first part 22A and rotational axis O in a cross section passing through rotational axis O and a part of first part 22A is greater than second angle $\theta_2$ formed between the second inner circumferential surface region of second part 22B and rotational axis O in a cross section passing through rotational axis O and a part of second part 22B. First length $L_1$ of first part 22A (first inner circumferential surface region) in the direction of the rotational axis is greater than second length $L_2$ of second part 22B (second inner circumferential surface region) in the direction of the rotational axis.

Blower apparatus 100, which includes flare portion 22 having first part 22A and second part 22B, can recover a static pressure of an inlet airflow from propeller fan 1.

In a conventional blower apparatus, the end of the flare portion located downstream is always disposed on the same plane perpendicular to the rotational axis irrespective of the magnitude of the flare angle (diffuser angle). A frictional loss is higher on the inner circumferential surface with a relatively small flare angle than on the inner circumferential surface with a relatively great flare angle. The conventional blower apparatus thus fails to sufficiently increase an efficiency of blowing air due to a frictional loss on the inner circumferential surface with a relatively small flare angle, and accordingly has difficulty in reducing input and noise. In contrast, in blower apparatus 100, second length $L_2$ of second part 22B with a small flare angle is smaller than first length $L_1$ of first part 22A. This allows blower apparatus 100 to reduce a pressure loss of an airflow due to a friction with the second inner circumferential surface region of second part 22B more than a conventional blower apparatus having second length $L_2$ which is provided to be equal to first length $L_1$. Consequently, blower apparatus 100 can reduce input and noise more than a conventional blower apparatus.

In blower apparatus 100, second angle $\theta_2$ is smaller than any other flare angle formed between the inner circumferential surface of flare portion 22 and rotational axis O. In this case, the second inner circumferential surface region of second part 22B is a part having the highest friction loss on the inner circumferential surface of flare portion 22. However, blower apparatus 100 has second length $L_2$ of second part 22B which is smaller than first length $L_1$ as described above, and can accordingly reduce a pressure loss of an airflow due to a friction with the second inner circumferential surface region of second part 22B more than a conventional blower apparatus. In addition, in blower apparatus 100, second length $L_2$ is smaller than any other shortest distance between the end of flare portion 22 located upstream and the end of flare portion 22 located downstream. This allows blower apparatus 100 to reduce a pressure loss of an airflow due to a friction with the second inner circumferential surface region of second part 22B and also increase the effect of recovering a static pressure at any part other than second part 22B in flare portion 22.

Embodiment 2

Figure 4:
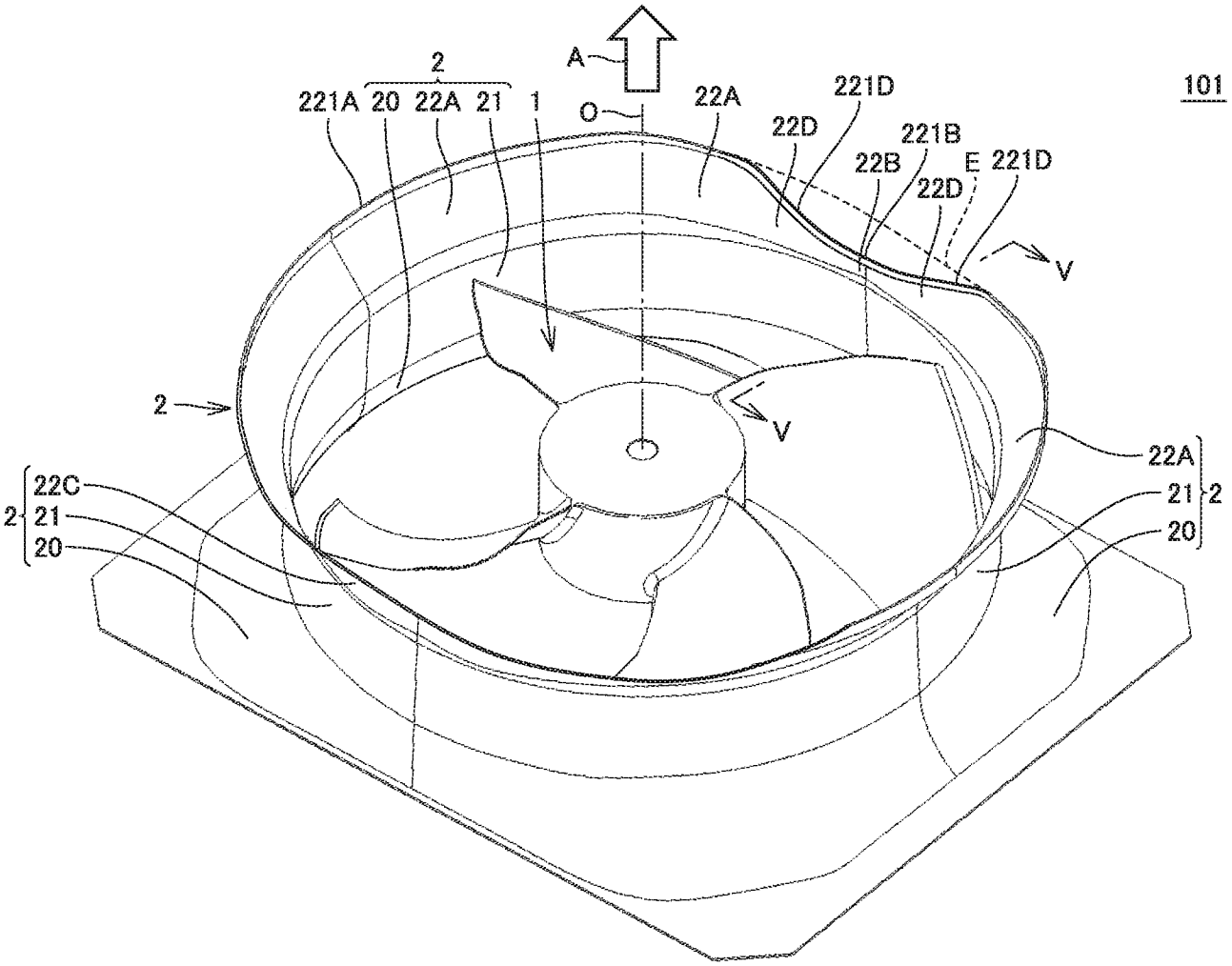
FIG. 4 is a perspective view of a blower apparatus according to Embodiment 2.
Figure 5:
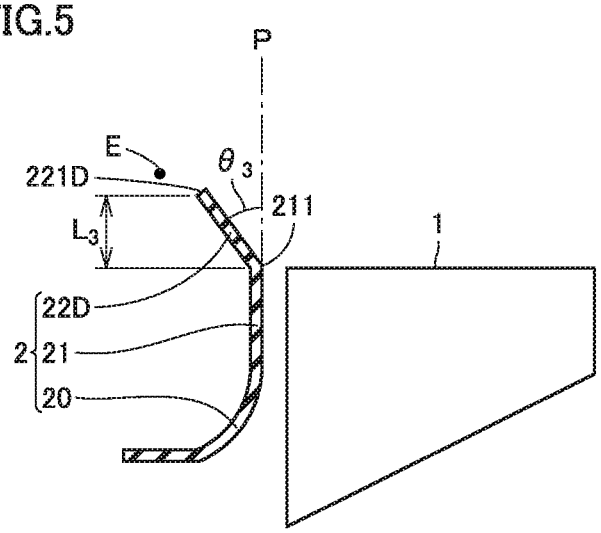
FIG. 5 is a sectional view seen from a line segment V-V in FIG. 4.

A blower apparatus 101 according to Embodiment 2 will now be described with reference to FIGS. 4 and 5. Blower apparatus 101 basically has the same configuration as that of blower apparatus 100 according to Embodiment 1 but differs from blower apparatus 100 in that flare portion 22 further includes a third part 22D connecting first part 22A and second part 22B to each other in the rotational direction of propeller fan 1. A dotted line E shown in FIG. 4 is similar to dotted line D shown in FIG. 1. Dotted line E shown in FIG. 4 is an imaginary line showing for reference a region in which end 221A located downstream is disposed in a conventional configuration in which no second part 22B and no third part 22D are provided (the configuration in which first part 22A is provided in place of second part 22B and third part 22D). An axis P shown in FIG. 5 is parallel to rotational axis O shown in FIG. 4.

For example, two third parts 22D are provided to sandwich second part 22B therebetween in the circumferential direction of flare portion 22. The inner circumferential surface of flare portion 22 has a third inner circumferential surface provided in third part 22D. A flare angle (third angle $\theta_3$ (see FIG. 5)) formed between the third inner circumferential surface of third part 22D and rotational axis O (axis P) becomes gradually smaller from the part connected to first part 22A to the part connected to second part 22B. Third angle $\theta_3$ in the part connected to first part 22A is equal to first angle $\theta_1$ of first part 22A. Third angle $\theta_3$ in the part connected to second part 22B is equal to second angle $\theta_2$ of second part 22B. Third angle $\theta_3$ changes gradually within a range from second angle $\theta_2$ to first angle $\theta_1$ inclusive.

Third part 22D has an end located upstream and an end 221D located downstream. The end of third part 22D located upstream is connected to the end of pipe portion 21 located downstream. The ends of first part 22A, second part 22B, and third part 22D located upstream are provided on the same plane orthogonal to rotational axis O. End 221D of third part 22D located downstream connects end 221A of first part 22A and end 221B of second part 22B to each other. First part 22A in blower apparatus 101 has no lateral end 222A (see FIG. 1).

A third length $L_3$ of third part 22D in the direction of the rotational axis (the shortest distance between the end of third part 22D located upstream and end 221D located downstream) becomes gradually smaller from first part 22A to second part 22B. Third length $L_3$ of the part connected to first part 22A is equal to first length $L_1$ of first part 22A. Third length $L_3$ of the part connected to second part 22B is equal to second length $L_2$ of second part 22B. Third length $L_3$ changes gradually within the range from second length $L_2$ to first length $L_1$ inclusive.

That is to say, third part 22D is provided to have greater third length $L_3$ with greater third angle $\theta_3$. As shown in FIGS. 4 and 5, end 221D of third part 22D is located upstream of dotted line E and is located at the side closer to the interior of flare portion 22 with respect to dotted line E in the radial direction of propeller fan 1.

Blower apparatus 101 as described above basically has a configuration similar to that of blower apparatus 100 and can thus achieve the function and effect similar to those of blower apparatus 100. Additionally, in blower apparatus 101, since first part 22A and second part 22B are connected to each other with third part 22D therebetween, a step is not formed, which is formed at the part connecting first part 22A and second part 22B to each other in blower apparatus 100. Blower apparatus 101 can thus reduce a pressure loss of an airflow due to a friction with inner circumferential surface of flare portion 22 more than blower apparatus 100, thereby reducing input and noise.

Second part 22B of blower apparatus 101 may be provided as, for example, one point in the circumferential direction of flare portion 22. For example, when the flare angle in a part in the circumferential direction of flare portion 22 is provided so as to become gradually smaller from first angle $\theta_1$ and become gradually greater again from first angle $\theta_1$, second part 22B may be provided as a point of inflection in this part. In this case, the part in the circumferential direction of flare portion 22 is provided such that the shortest distance between the end thereof located upstream and the end thereof located downstream becomes gradually smaller from first length $L_1$ and become gradually greater again to first length $L_1$, and second part 22B is provided as a point Of inflection of the shortest distance at the part. In blower apparatus 101, the angle formed between the opposite ends of second part 22B in the circumferential direction of flare portion 22 with respect to the central axis (rotational axis O) of flare portion 22 may have any magnitude exceeding 0°.

Hare portions 22 of blower apparatuses 100 and 101 according to Embodiments 1 and 2 may have any configuration as long as they have first part 22A and second part 22B adjacent to each other. First part 22A may be provided in a C-shape across flare portion 22 except for second part 22B in the circumferential direction of flare portion 22. The blower apparatus provided as described above also basically has a configuration similar to the configurations of blower apparatuses 100 and 101, and thus can achieve similar effects to those of blower apparatuses 100 and 101.

Embodiment 3

Figure 6:
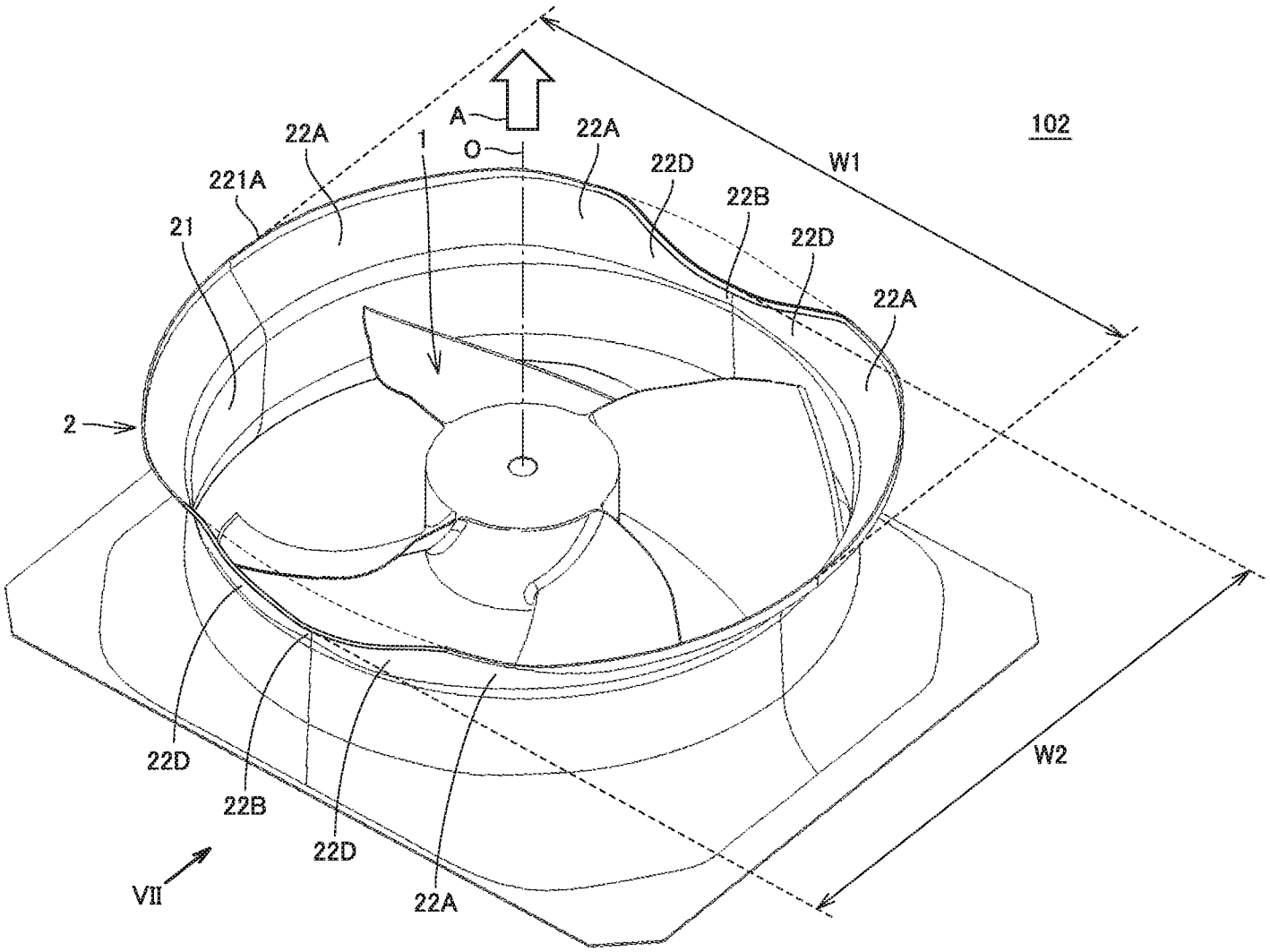
FIG. 6 is a perspective view of a blower apparatus according to Embodiment 3.

A blower apparatus 102 according to Embodiment 3 will now be described with reference to FIGS. 6 to 8. Blower apparatus 102 basically has a configuration similar to that of blower apparatus 100 according to Embodiment 1 or blower apparatus 101 according to Embodiment 2, but differs from blower apparatus 100 or blower apparatus 101 in that two first parts 22A are provided at positions facing each other with rotational axis O therebetween, and that two second parts 22B are provided at positions facing each other with rotational axis O therebetween. First parts 22A and second parts 22B are arranged alternately in the circumferential direction of flare portion 22 (in the rotational direction of propeller fan 1). FIG. 6 shows an example configuration in which two first parts 22A and two second pails 22B of blower apparatus 101 shown in FIG. 4 are provided as an example of blower apparatus 102. First parts 22A are provided at positions facing each other with rotational axis O therebetween, and second parts 22B are provided at positions facing each other with rotational axis O therebetween.

Figure 7:
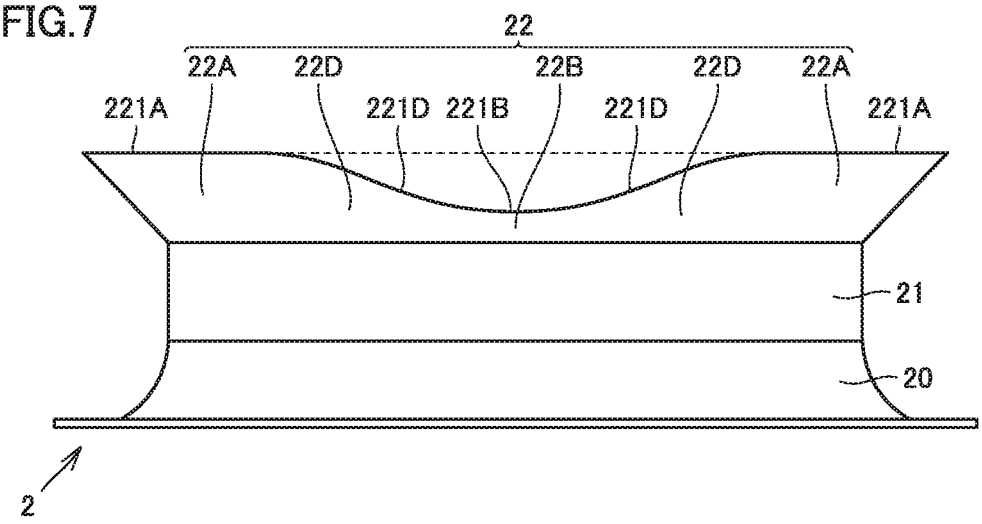
FIG. 7 is a side view seen from an arrow VII in FIG. 7.

As shown in FIGS. 6 and 7, adjacent first part 22A and second part 22B are arranged with, for example, third part 22D therebetween. Third part 22D connects first part 22A and second part 22B to each other in the circumferential direction of flare portion 22. Four third parts 22D are provided at positions facing each other with rotational axis O therebetween. Flare portion 22 of blower apparatus 102 is provided to have point symmetry about the central axis thereof (rotational axis O of propeller fan 1). In flare portion 22, a distance W1 between the outer circumferential surfaces of first parts 22A that face each other with rotational axis O therebetween is greater than a distance W2 between the outer circumferential surfaces of second parts 22B that face each other with rotational axis O therebetween. Bell mouth 2 has a major axis and a minor axis or a long side and a short side when blower apparatus 100 is seen in the direction of the rotational axis. The minor axis (short side) of bell mouth 2 extends in the direction in which two second parts 22B face each other with rotational axis O therebetween. The major axis (long side) of bell mouth 2 extends in the direction in which two first parts 22A face each other with rotational axis O therebetween.

When bell mouth 2 of blower apparatus 102 is seen in the direction perpendicular to rotational axis O as shown in FIG. 7, ends 221B and 221D of second part 22B and third part 22D located downstream are provided as a recess that is recessed from end 221A of first part 22A toward upstream side.

Blower apparatus 102 described above basically has a configuration similar to that of blower apparatus 101 and can accordingly achieve effects similar to those of blower apparatus 101.

Figure 8:
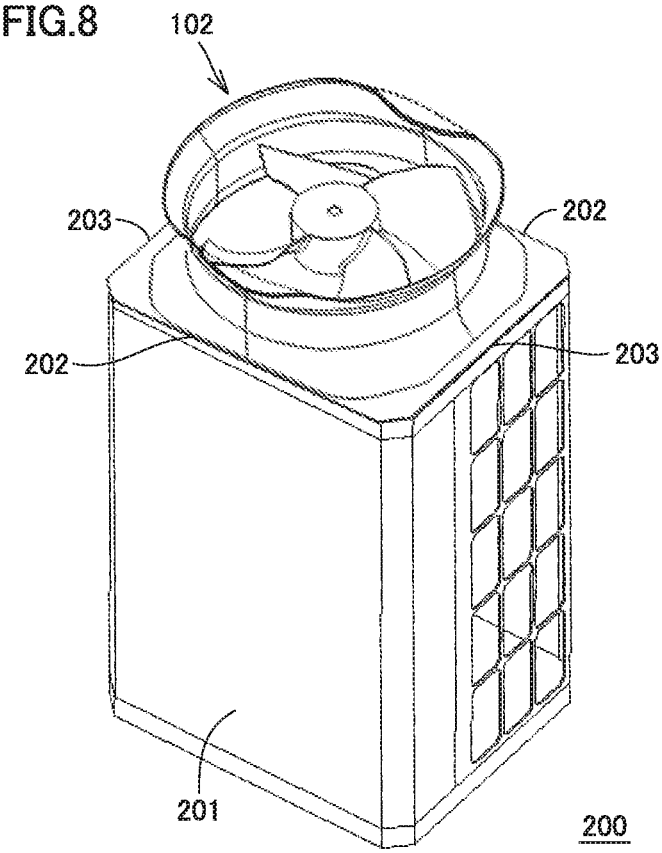
FIG. 8 is a perspective view of an outdoor unit including the blower apparatus according to Embodiment 3.

With reference to FIG. 8, blower apparatus 102 is suitable for, for example, an axial-flow fan of outdoor unit 200. Outdoor unit 200 includes blower apparatus 102 and an outdoor heat exchanger 201 disposed upstream of blower apparatus 102. When outdoor unit 200 is seen in the direction of the rotational axis of blower apparatus 102, outdoor heat exchanger 201 has an approximately rectangular outside shape with, for example, long sides 202 and short sides 203. Outdoor unit 200 is provided such that the major axis of bell mouth 2 of blower apparatus 102 extends along long sides 202 of outdoor heat exchanger 201 and that the minor axis of bell mouth 2 extends along short sides 203 of outdoor heat exchanger 201. Since blower apparatus 102 is miniaturized more in the minor axis direction more than a conventional blower apparatus, outdoor unit 200 described above can be miniaturized more than an outdoor unit including a conventional blower apparatus. Since blower apparatus 102 is also miniaturized in the minor axis direction more than blower apparatus 100, 101 outdoor unit 200 including blower apparatus 102 can also be miniaturized more than the outdoor unit including blower apparatus 100, 101.

Flare portion 22 of blower apparatus 102 does not need to be provided to have point symmetry about the central axis thereof (rotational axis O of propeller fan 1). The flare part of flare portion 22 which faces second part 22B with rotational axis O therebetween may have a flare angle and a length in the direction of the rotational axis which differ from those of first part 22A and second part 22B. For example, the flare part of flare portion 22 which faces second part 22B with rotational axis O therebetween may have a flare angle more than second angle $\theta_2$ and less than first angle $\theta_1$ and have a length in the direction of the rotational axis more than second length $L_2$ and less than first length $L_1$.

Two blower apparatuses 102 may be provided at positions at which first part 22A and second part 22B of blower apparatus 100 shown in FIG. 1 face each other with rotational axis O therebetween.

In blower apparatus 102, three or more second parts 22B may be provided at intervals therebetween in the circumference direction of flare portion 22. An odd number of second parts 22B may be provided, or an even number of second parts 22B may be provided. Second parts 22B are provided at regular intervals, for example, in the circumferential direction of flare portion 22.

In flare portions 22 of blower apparatuses 100, 101, and 102, the flare part facing first part 22A with rotational axis O therebetween may have a flare angle and a length in the direction of the rotational axis which are different from those of first part 22A and second part 22B.

Embodiment 4

Figure 9:
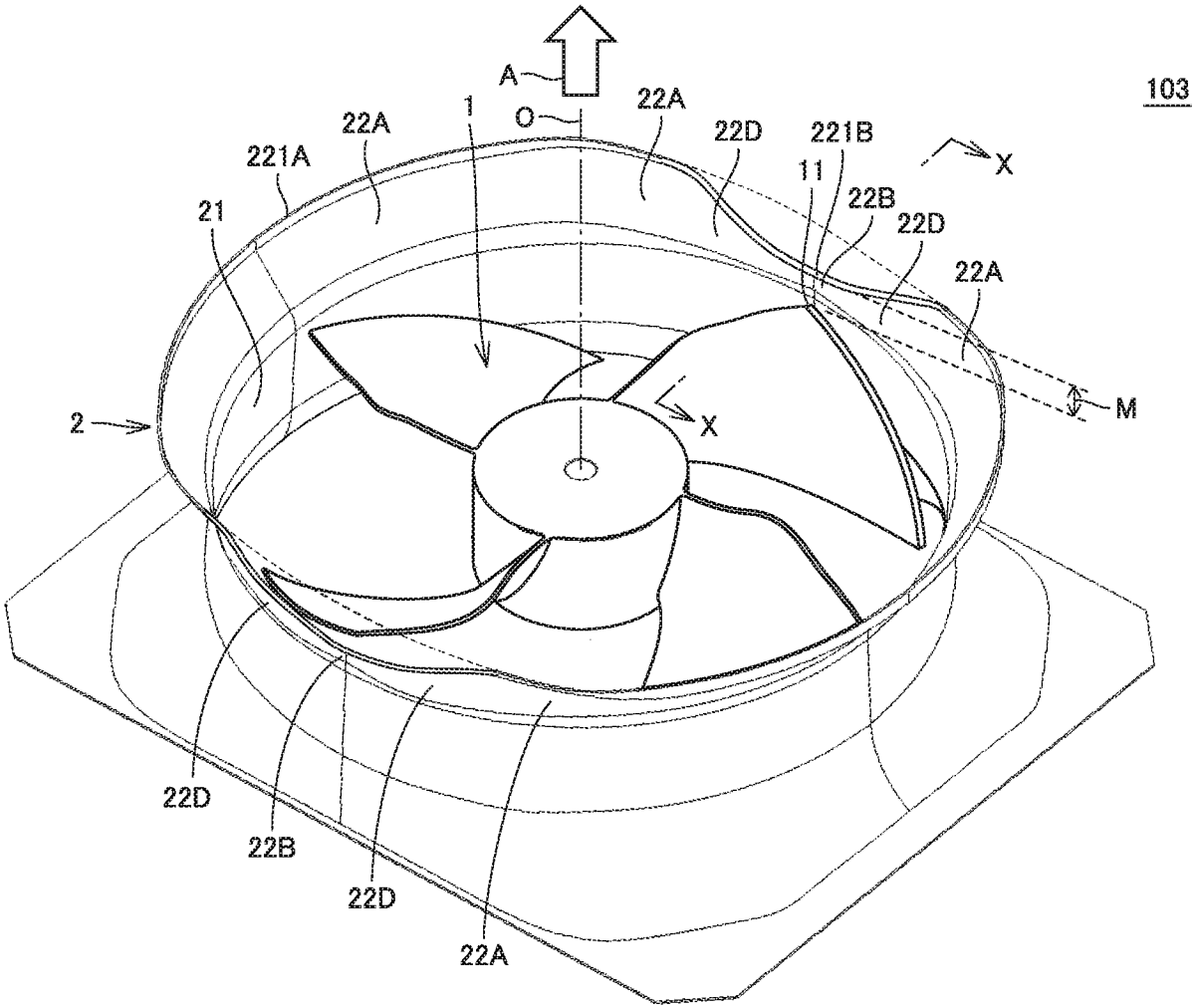
FIG. 9 is a perspective view of an outdoor unit including a blower apparatus according to Embodiment 4.
Figure 10:
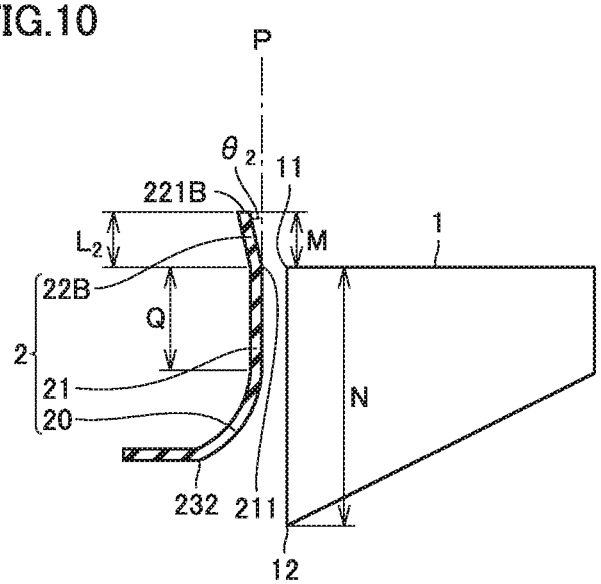
FIG. 10 is a sectional view seen from a line segment X-X in FIG. 9.

A blower apparatus 103 according to Embodiment 4 will now be described with reference to FIGS. 9 and 10. Blower apparatus 103 basically has a configuration similar to that of blower apparatus 102 according to Embodiment 3. Propeller fan 1 has an end 11 (first end) located downstream and an end 12 (third end) located upstream. Second part 22B of flare portion 22 has an end 221B (second end) located downstream. End 221B (second end) of second pan 22B is located downstream of end 11 (first end) of propeller fan 1. An axis P shown in FIG. 10 is parallel to a rotational axis O shown in FIG. 9.

Blower apparatus 103 has a length M (see FIG. 10) between end 221B (second end) and end 11 (first end) which is 10% or more of a length N (see FIG. 10) between end 11 (first end) and end 12 (third end) (a ratio M/N is 10% or more) in the direction of the rotational axis of propeller fan 1.

An airflow emitted from propeller fan 1 flows from the interior space of flare portion 22 located downstream of end 11 of propeller fan 1 and upstream of end 221B of second part 22B to the exterior space located downstream of end 221B of second part 22B. In a blower apparatus with a ratio M/N of less than 10%, thus, a sectional area perpendicular to rotational axis O increases sharply, which more easily causes an eddy. In contrast, blower apparatus 103 with a ratio M/N of 10% or more has a sufficiently large second length $L_2$ of second part 22B and a suppressed increase rate of the cross section compared with a blower apparatus having a ratio M/N of less than 10%. This reduces the formation of an eddy in blower apparatus 103, thus reducing an eddy loss. Blower apparatus 103 can thus reduce input and noise more than the blower apparatus with a ratio M/N of less than 10%. In addition, blower apparatus 103 basically has a configuration similar to that of blower apparatus 102, and can accordingly achieve effects similar to those of blower apparatus 102.

End 11 of propeller fan 1 and end 211 of pipe portion 21 of pipe portion 21 located downstream are provided on, for example, the same plane orthogonal to rotational axis O. In other words, end 11 and end 211 are provided, for example, with an interval therebetween in the radial direction of propeller fan 1. In this case, a length M between end 11 of propeller fan 1 and end 221B of second part 22B is equal to second length $L_2$ of second part 22B.

An end 232 of bell mouth 2 which is located upstream (the end of curved inlet portion 20 located upstream) is provided downstream of, for example, end 12 of propeller fan 1 located upstream. In this case, second length $L_2$ is 10% or more of a length Q (see FIG. 10) between end 232 of curved inlet portion 20 located upstream and end 211 of pipe portion 21 located downstream.

Embodiment 5

Figure 11:
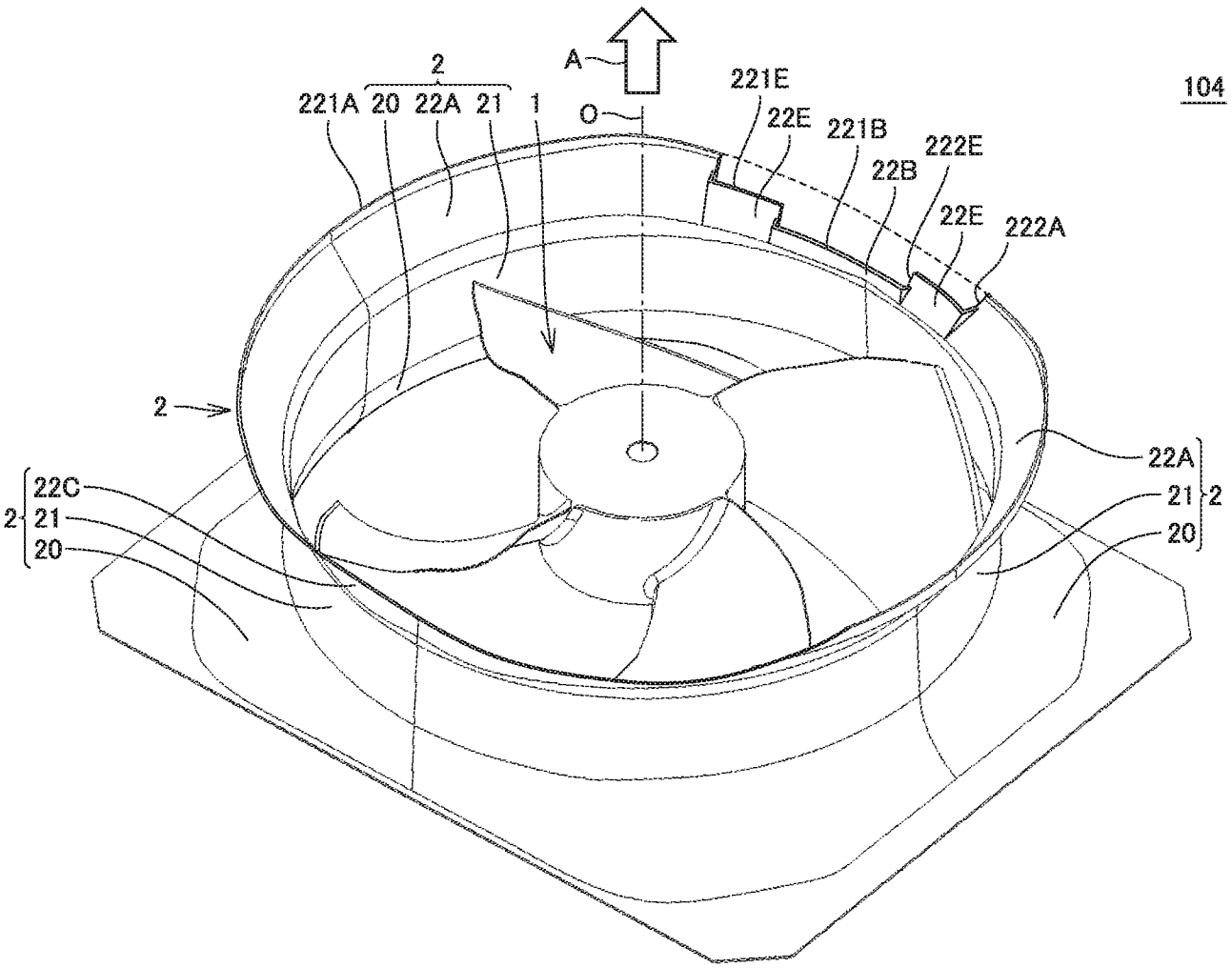
FIG. 11 is a perspective view of an outdoor unit including a blower apparatus according to Embodiment 5.

A blower apparatus 104 according to Embodiment 5 will now be described with reference to FIG. 11. Blower apparatus 104 basically has a configuration similar to that of blower apparatus 100 according to Embodiment 1 but differs from blower apparatus 100 in that flare portion 22 further has a fourth part 22E connecting first part 22A and second part 22B to each other.

Fourth part 22E has a flare angle more than second angle $\theta_2$ and less than first angle $\theta_1$. Fourth part 22E has an end located upstream and an end 221E located downstream. The end of fourth part 22E located upstream is connected to the end of pipe portion 21 located downstream. The ends of first part 22A, second part 22B, and fourth part 22E located upstream are provided on the same plane orthogonal to rotational axis O. The ends of first part 22A, second part 22B, and fourth part 22E located downstream are not provided on the same plane orthogonal to rotational axis O.

First part 22A has a lateral end 222A in the circumferential direction of flare portion 22. Lateral end 222A of first part 22A connects end 221A of first part 22A located downstream and end 221E of fourth part 22E located downstream to each other. Fourth part 22E has a lateral end 222E in the circumferential direction of flare portion 22. Lateral end 222E of fourth part 22E connects end 221E of fourth part 22E located downstream and end 221B of second part 22B located downstream to each other.

A distance between the end of fourth part 22E located upstream and end 221E located downstream in the direction of the rotational axis is more than second length $L_2$ and is less than first length $L_1$.

Blower apparatus 104 configured as described above basically has a configuration similar to that of blower apparatus 100, and can thus achieve effects similar to those of blower apparatus 100.

It should be understood that the embodiments disclosed herein are illustrative and non-restrictive in every respect. It is therefore intended that the scope of the present invention is defined by claims, not only by the embodiments described above, and encompasses all modifications and variations equivalent in meaning and scope to the claims.

INDUSTRIAL APPLICABILITY

The present invention is particularly advantageously applied to a blower apparatus of an air conditioner.

REFERENCE SIGNS LIST

1 propeller fan, 2 bell mouth, 20 curved inlet portion, 21 pipe portion, 22 flare portion, 22A first part, 22B second part, 22C flare part, 22D third part, 22E fourth part, 100, 101, 102, 103, 104 blower apparatus, 200 outdoor unit, 201 outdoor heat exchanger.

The invention claimed is:

1. A blower apparatus comprising:

a propeller fan configured to rotate about a rotational axis; and a bell mouth annularly disposed to surround the propeller fan as seen in a direction of the rotational axis of the propeller fan, the bell mouth having a bell-mouth-upstream end which is located on an upstream end of the bell mouth, the propeller fan has a first end and a third end opposite to the first end, the first end is located on a downstream end of the propeller fan in the direction of the rotational axis, and the third end is located on an upstream end of the propeller fan in the direction of the rotational axis, the bell mouth comprising a flare portion located downstream of the propeller fan in the direction of the rotational axis, the flare portion having a flare-portion-upstream end which is located on an upstream end of the flare portion in the direction of the rotational axis, the flare portion having an inner circumferential surface located inside in a radial direction of the propeller fan, the inner circumferential surface being inclined with respect to the rotational axis, with a distance between the inner circumferential surface and the rotational axis increasing downstream in the direction of the rotational axis, the flare portion having at least one first part and at least one second part located at different positions in a rotational direction of the propeller fan, the at least one first part having a first inner circumferential surface region that is a part of the inner circumferential surface, the at least one second part having a second inner circumferential surface region that is a part of the inner circumferential surface, a first angle formed between the first inner circumferential surface region of the at least one first part and the rotational axis in a cross section passing through the rotational axis and a part of the at least one first part being greater than a second angle formed between the second inner circumferential surface region of the at least one second part and the rotational axis in a cross section passing through the rotational axis and a part of the at least one second part, a first length of the first inner circumferential surface region in the direction of the rotational axis being greater than a second length of the second inner circumferential surface region in the direction of the rotational axis, the third end of the propeller fan, which is located on the upstream end of the propeller fan, is provided upstream of the bell-mouth-upstream end, the first end of the propeller fan, which is located on the downstream end of the propeller fan, and the flare-portion-upstream end, which is located on the upstream end of the flare portion, are provided on a same plane which is perpendicular to the rotational axis.

2. The blower apparatus according to claim 1, wherein the second angle is smaller than any other angle formed between the inner circumferential surface of the flare portion and the rotational axis.

3. The blower apparatus according to claim 1, wherein the flare portion further has at least one third part connecting the at least one first part and the at least one second part to each other in the rotational direction, the at least one third part has a third inner circumferential surface region that is a part of the inner circumferential surface, the third inner circumferential surface region is inclined with respect to the rotational axis, with a distance between the third inner circumferential surface region and the rotational axis increasing downstream in the direction of the rotational axis, a third angle formed between the third inner circumferential surface region of the at least one third part and the rotational axis becomes gradually smaller from the at least one first part toward the at least one second part, and a third length of the third inner circumferential surface region in the direction of the rotational axis becomes gradually smaller from the at least one first part to the at least one second part.

4. The blower apparatus according to claim 1, wherein the at least one first part comprises two or more first parts at positions facing each other with the rotational axis of the propeller fan therebetween, and the at least one second part comprises two or more second parts disposed at positions facing each other with the rotational axis of the propeller fan therebetween, and the two or more first parts and the two or more second parts are arranged alternately in the rotational direction.

5. The blower apparatus according to claim 1, wherein the at least one second part has a second end located downstream in the direction of the rotational axis, and a length between the first end and the second end in the direction of the rotational axis is 10% or more of a length of the propeller fan in the direction of the rotational axis.

6. The blower apparatus according to claim 1, wherein the at least one second part has a second end located downstream in the direction of the rotational axis, and (i) a length between (a) the first end of the propeller fan and (b) the second end of the flare portion in the direction of the rotational axis is 10% or more of (ii) a length between (c) the first end of the propeller fan and (d) the third end of the propeller fan in the direction of the rotational axis.

* * * * *